US005277488A

United States Patent [19]

Cleary et al.

[11] Patent Number: 5,277,488

[45] Date of Patent: Jan. 11, 1994

[54] REFRIGERATOR WITH ROTATABLE SHELVES

[76] Inventors: Liam Cleary; Susan Cleary, both of 5, Foxholes Close, Rochdale, Lancashire, United Kingdom, 0L12 OEE

[21] Appl. No.: 887,050

[22] Filed: May 22, 1992

[51] Int. Cl.[5] ..... A47B 49/00; A47F 3/04; A47F 5/02; A47J 47/00

[52] U.S. Cl. ..... 312/408; 312/116; 312/305; 312/249.2; 211/144; 211/131

[58] Field of Search ..... 312/116, 125, 135, 305, 312/249.2, 236, 408, 229, 401; 211/144, 187, 131; 62/80

[56] References Cited

U.S. PATENT DOCUMENTS

| | | | |
|---|---|---|---|
| 615,032 | 11/1898 | Mandel | 312/135 |
| 986,875 | 3/1911 | Tilghman | 312/116 |
| 1,551,879 | 9/1925 | Hoffman | 312/305 |
| 2,680,668 | 6/1954 | Stanfiel et al. | 312/305 |
| 2,693,989 | 11/1954 | Santana et al. | 312/135 |
| 3,299,664 | 1/1967 | Booth | 312/236 |
| 3,794,952 | 2/1974 | Dowis | 439/21 |
| 3,858,529 | 1/1975 | Salladay | 108/103 |
| 3,899,896 | 8/1975 | Bryant | 62/80 |
| 4,123,130 | 10/1978 | Locke | 312/236 |
| 4,181,037 | 1/1980 | Boon et al. | 74/569 |
| 4,433,885 | 2/1984 | Baker | 312/305 |
| 4,549,664 | 10/1985 | Gowan et al. | 312/125 |
| 4,627,543 | 12/1986 | Nicely | 211/187 |
| 4,948,207 | 8/1990 | Rolls et al. | 312/306 |
| 5,183,167 | 2/1993 | Cheng | 211/187 |

*Primary Examiner*—P.W. Echols
*Assistant Examiner*—David P. Bryant
*Attorney, Agent, or Firm*—Leon Gilden

[57] ABSTRACT

A refrigerator or freezer of a storage refrigerator unit includes a central support shaft mounted within the refrigeration cabinet having support containers adjustably mounted along the support shaft. The shaft structure is rotatably mounted within the cabinet for access to various portions of each container.

4 Claims, 4 Drawing Sheets

REFRIGERATOR WITH ROTATABLE SHELVES

BACKGROUND OF THE INVENTION

1. Field of the Invention

The field of invention relates to refrigeration apparatus, and more particularly pertains to a new and improved refrigerator shelf apparatus wherein the same is arranged to rotatably mount support shelves.

2. Description of the prior Art

Access to various component portions of a refrigeration housing, such as a freezer or refrigerator unit, is rendered relatively inaccessible to many individuals of impaired physical abilities when requiring such individuals to gain access to various portions of such container structure at remote interior portions of an associated refrigeration cabinet. The instant invention attempts to overcome deficiencies of the prior art by providing for the basket or container structures to be rotatably mounted within the refrigeration unit about a central shaft.

Prior art refrigeration shelf structure is exemplified in U.S. Pat. Nos. 4,433,885; 4,181,037; 3,858,529; 3,794,952; and 4,948,207.

Accordingly, there continues to be a need for a new and improved refrigerator shelf apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of refrigerator shelf apparatus now present in the prior art, the present invention provides a refrigerator shelf apparatus wherein the same rotatably mounts the shelf structure relative to the central post of the refrigeration cabinet. As such, the general purpose of the present invention, which will be described subsequently in greater detail, is to provide a new and improved refrigerator shelf apparatus which has all the advantages of the prior art refrigerator shelf apparatus and none of the disadvantages.

To attain this, the present invention provides a refrigerator or freezer of a storage refrigerator unit including a central support shaft mounted within the refrigeration cabinet having support containers adjustably mounted along the support shaft. The shaft structure is rotatably mounted within the cabinet for access to various portions of each container.

My invention resides not in any one of these features per se. but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved refrigerator shelf apparatus which has all the advantages of the prior art refrigerator shelf apparatus and none of the disadvantages.

It is another object of the present invention to provide a new and improved refrigerator shelf apparatus which may be easily and efficiently manufactured and marketed.

It is a further object of the present invention to provide a new and improved refrigerator shelf apparatus which is of a durable and reliable construction.

An even further object of the present invention is to provide a new and improved refrigerator shelf apparatus which is susceptible of a low cost of manufacture with regard to both materials and labor, and which accordingly is then susceptible of low prices of sale to the consuming public, thereby making such refrigerator shelf apparatus economically available to the buying public.

Still yet another object of the present invention is to provide a new and improved refrigerator shelf apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
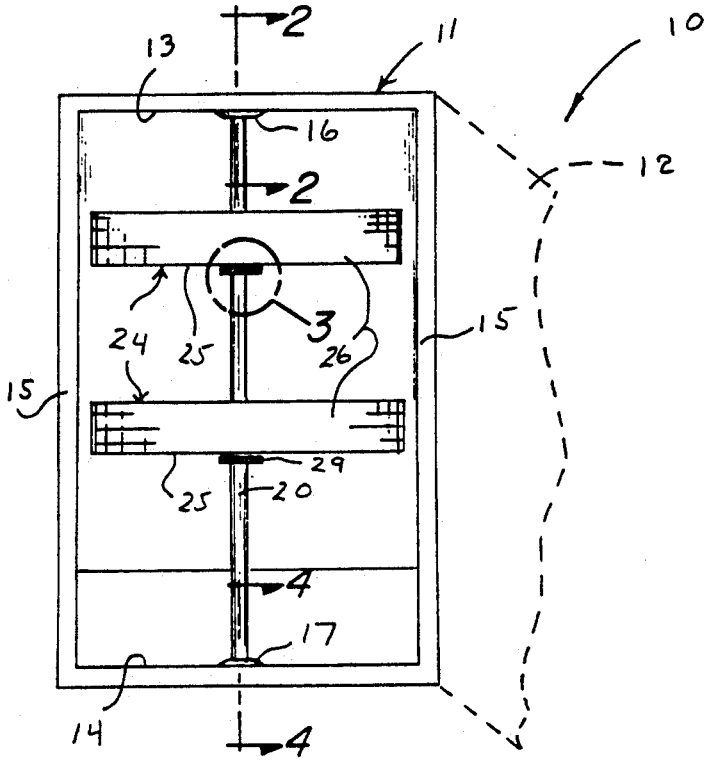
FIG. 1 is an orthographic view of the invention mounted within a refrigeration cabinet.
Figure 2:
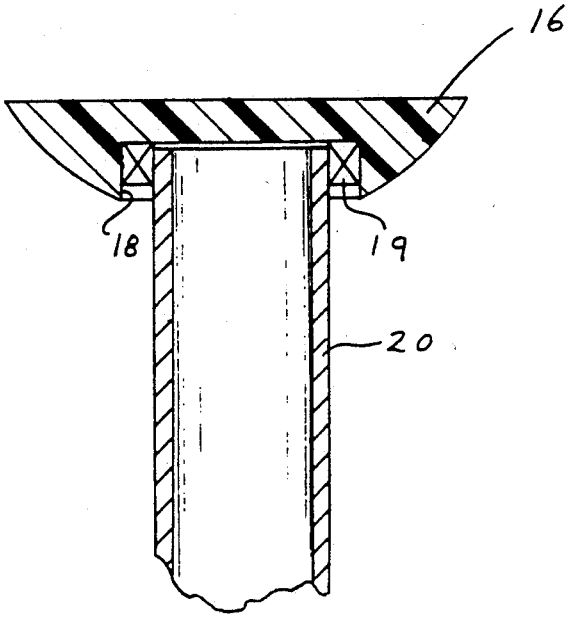
FIG. 2 is an orthographic view, taken along the lines 2—2 of FIG. 1 in the direction indicated by the arrows.
Figure 3:
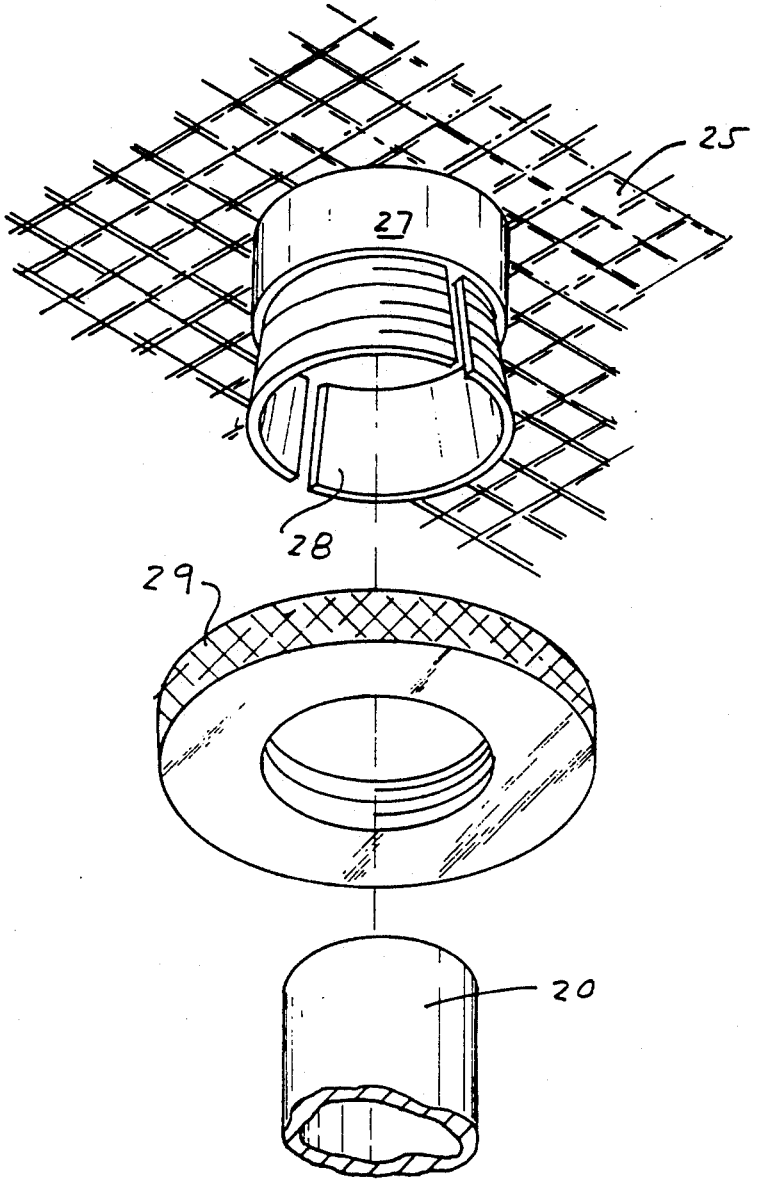
FIG. 3 is an isometric exploded illustration of section 3 as set forth in FIG. 1.
Figure 4:
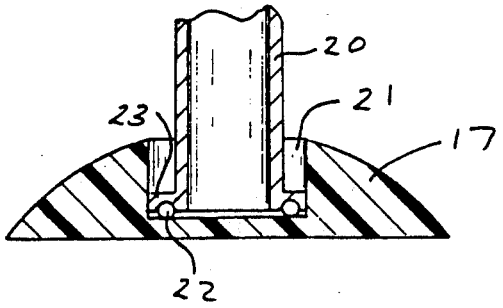
FIG. 4 is an orthographic view, taken along the lines 4—4 of FIG 1 in the direction indicated by the arrows.
Figure 5:
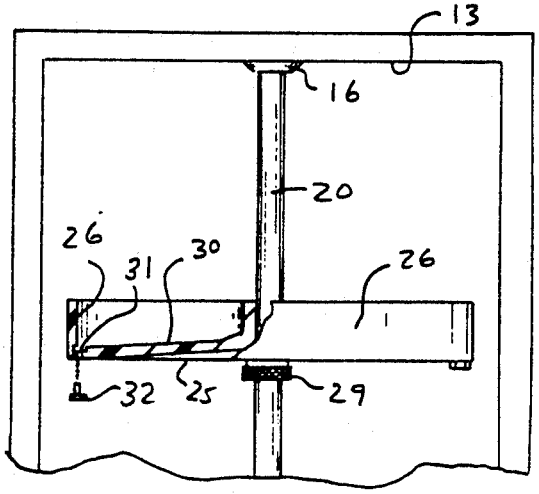
FIG. 5 is an orthographic view, partially in section, of the container structure utilized by the invention.

With reference now to the drawings, and in particular to FIGS. 1 to 8 thereof, a new and improved refrigerator shelf apparatus embodying the principles and concepts of the present invention and generally designated by the reference numeral 10 will be described.

More specifically, the refrigerator shelf apparatus 10 of the instant invention essentially comprises a refrigeration cabinet 11 having a cabinet door 12 hingedly mounted to the cabinet 11, with the cabinet 11 including a cabinet top wall 13 spaced above a cabinet floor 14, with the cabinet further being provided with side walls 15 defining a cabinet cavity therebetween. A top support cup 16 is fixedly mounted medially of the top wall 13 coaxially aligned with a bottom support cup 17 mounted fixedly to the floor 14. A mounting shaft 29 extends coextensively between the top support cup 16 and the bottom support cup 17 and received within a top support cup cylindrical cavity 18 at an upper distal end of the mounting shaft and a bottom support cup cavity 21 within a lower distal end of the mounting shaft 20. The top cylindrical cavity 18 includes a top bearing 19, with the bottom support cup cavity 21 having a thrust bearing 21 interposed between a floor of the bottom support cup cavity 21, and a mounting shaft flange 23 fixedly and integrally mounted to a lower distal end of the mounting shaft 20.

A plurality of support containers 24, or alternatively of baskets, are fixedly mounted at spaced intervals along the mounting shaft 20, whereupon the mounting shaft 20 rotatably mounted to respective top and bottom support cups 16 and 17 by the associated bearing structure permits selective rotation of the support containers.

Each support container 24 includes a container bottom wall 25, with a continuous side wall 26 having a center container tubular boss 27 fixedly mounted to the coaxial center of the bottom wall 25 having an externally threaded split collet 28 coaxially mounted to the tubular boss 27 extending downwardly thereof, with a clamp ring 29 arranged for securement about the collet 28 to fixedly secure each respective support containers 24 in longitudinally aligned adjustable relationship along the mounting shaft 20.

Each container includes a container floor 30 within the container spaced above the bottom wall 25, with the container floor 30 canted downwardly from the container collar 36 to the continuous side wall 26. A plurality of drain apertures 31 diametrically positioned relative to one another are directed through the container floor 30 projecting through the container bottom wall 25 having an aperture plug 32 removably mounted to each aperture 31 to permit drainage within each container, with the apertures positioned at a junction of the side wall 26 with the floor 30.

Figure 6:
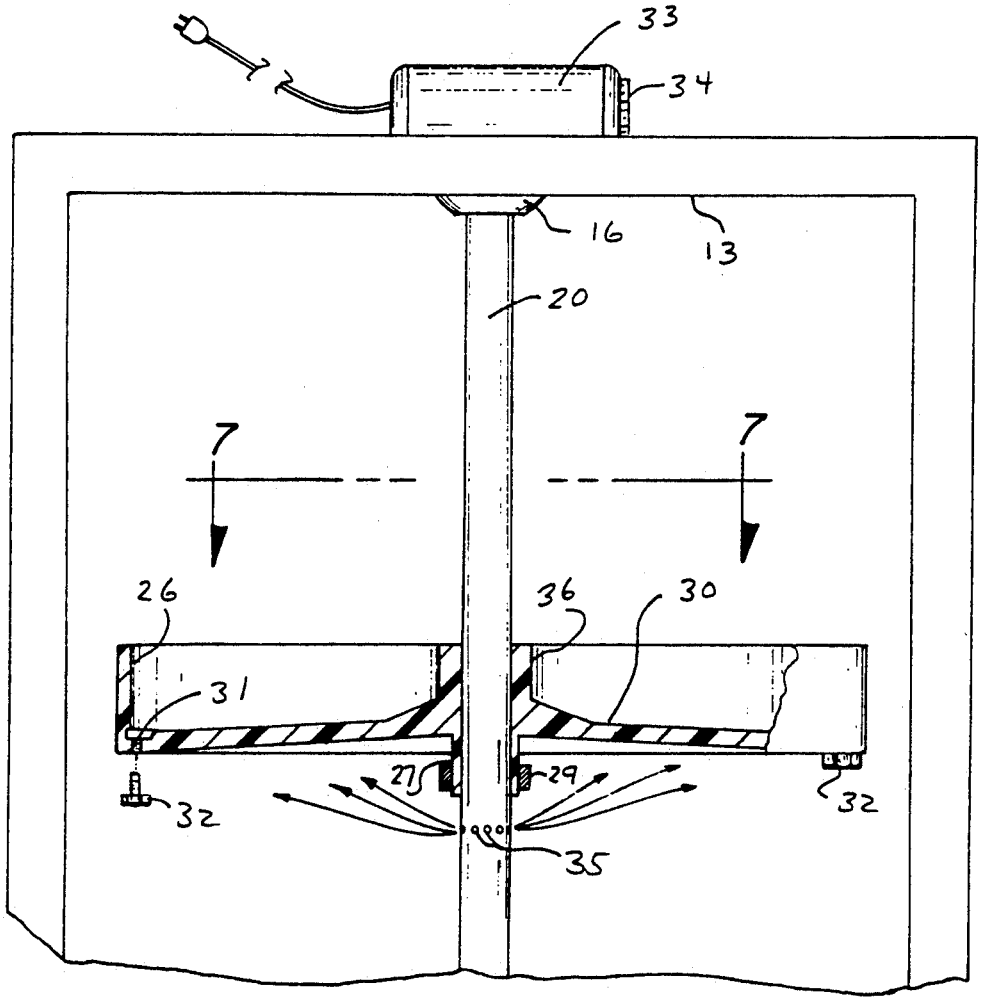
FIG. 6 is an orthographic view, partially in section, of the container units in association with a tubular support shaft directing defrosting air flow into the refrigeration cabinet.
Figure 7:
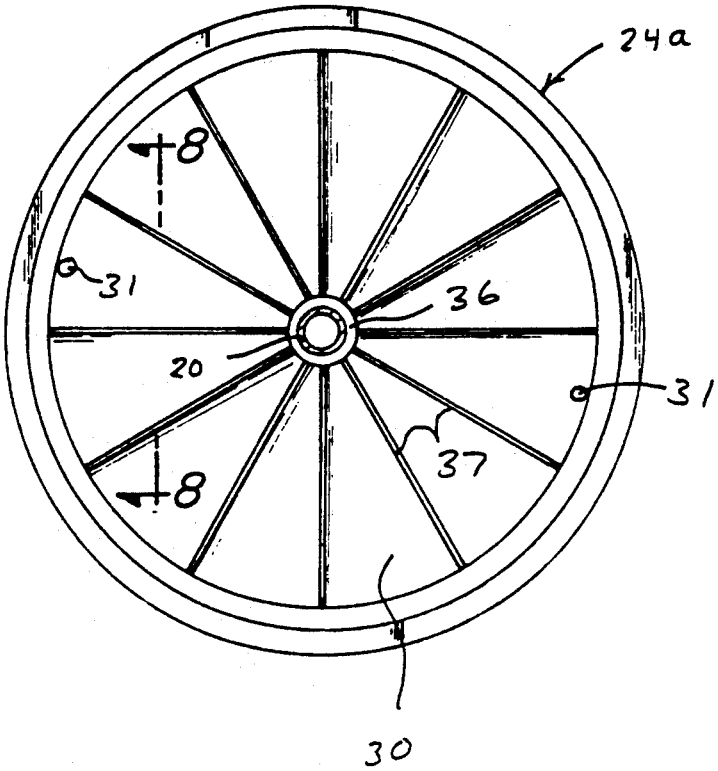
FIG. 7 is an orthographic top view of a further modified container structure utilized by the invention.
Figure 8:
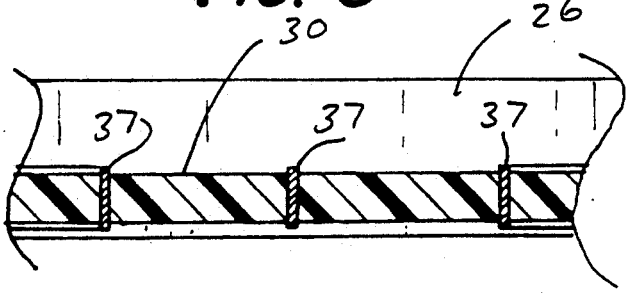
FIG. 8 is an orthographic view, taken along the lines 8—8 of FIG. 7 in the direction indicated by the arrows.

The FIG. 6 illustrates the use of a blower motor 33 mounted to the cabinet structure having a blower motor intake grid 34 to direct pressurized ambient temperature air surrounding the refrigerator cabinet 11 into the tubular mounting shaft 20 to be projected through a circumferential array of air outlet ports 35 between the containers 24 to assist in defrosting of the refrigerator structure.

Further, a modified cabinet structure 24*a* is further arranged with a plurality of metallic vanes 27 radially directed from the metallic container collar 36 slidably receiving the mounting shaft 20 therethrough to the container side wall 26. The metallic vanes 37 enhance each container 24*a* by effecting radiant transmission of heat from the tubular mounting shaft 20 when the defrosting or ambient air in surrounding relationship relative to the cabinet 11 is directed through the mounting shaft 20 and through the air outlet ports 35.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters patent of the United States is as follows:

1. A refrigerator and shelf apparatus, comprising, a refrigerator cabinet, the cabinet having a cabinet door and including a cabinet top wall, a cabinet floor, and spaced cabinet side walls to define a cabinet cavity therewithin, a top support cup mounted within the cabinet cavity to the top wall, and a bottom support cup coaxially aligned with the top support cup mounted fixedly to the cabinet floor within the cabinet cavity, a mounting shaft rotatably mounted between the top support cup and the bottom support cup, at least one support container mounted to the mounting shaft, the top support cup includes a top support cup cylindrical cavity, and the bottom support cup includes a bottom support cup cylindrical cavity, and a top bearing mounted within the top support cup cavity to rotatably position an upper distal end of the mounting shaft therewithin, and the mounting shaft including a mounting shaft lower distal end, the lower distal end including a mounting flange, and a thrust bearing captured between the mounting shaft flange and the bottom support cup cavity, and the support container includes a support container bottom wall and a support container continuous side wall, and a metallic container collar positioned medially of the support container bottom wall, the metallic container collar projecting below the support container bottom wall and including an externally threaded split collet receiving the mounting shaft therethrough, and a clamp ring rotatably mounted about the split collet to effect securement of the split collet about the mounting shaft.

2. An apparatus as set forth in claim 1 wherein the support container includes a container floor within the support container, the floor canted downwardly from the metallic container collar to the continuous side wall, and a plurality of drain apertures diametrically opposed relative to one another directed through the container floor, with each drain aperture including a drain aperture plug removably mounted to the drain aperture to permit selective drainage of each support container.

3. An apparatus as set forth in claim 2 wherein the mounting shaft is tubular and includes a blower motor in pneumatic communication with the tubular mounting shaft, the blower motor mounted to the refrigeration cabinet and the blower motor operative to direct ambient air exterior of the cabinet through the tubular mounting shaft, and the mounting shaft including a circular array of air outlet ports directed through the mounting shaft to direct said ambient air into the cabinet cavity during a refrigeration defrosting procedure.

4. An apparatus as set forth in claim 3 wherein the support container further includes a plurality of metallic vanes radially directed from the metallic container collar to the support container continuous side wall imbedded within the container floor

* * * * *